United States Patent [19]

Bilberry

[11] Patent Number: 4,501,023

[45] Date of Patent: Feb. 26, 1985

[54] NECK SUPPORT

[76] Inventor: Johnny B. Bilberry, 133 Holcomb Dr., Shreveport, La. 71103

[21] Appl. No.: 299,653

[22] Filed: Sep. 8, 1981

[51] Int. Cl.[3] ..... A41D 13/00

[52] U.S. Cl. ..... 2/2; 2/44

[58] Field of Search ..... 2/2, 44, 45; 128/163, 128/DIG. 23

[56] References Cited

U.S. PATENT DOCUMENTS

| | | | |
|---|---|---|---|
| 1,970,130 | 8/1934 | Dickerson | 2/2 |
| 3,497,872 | 3/1970 | Mitchell | 2/2 |
| 4,338,685 | 7/1982 | LaPorta, Jr. | 2/2 |

*Primary Examiner*—Doris L. Troutman

*Attorney, Agent, or Firm*—John M. Harrison

[57] ABSTRACT

A neck support for use in athletic contact sports such as football, which includes a resilient, yieldable collar having at least one front support extending downwardly from the collar beneath an athlete's chin, and attached to his shoulder harness or pads. The collar intercepts the chin, and the collar and front support together prevent downward movement of the athlete's head past a predetermined position to prevent undesirable hyper-flexure of the cervical vertebrae and damage to the cervical spine, responsive to a blow or blows delivered to the athlete's head.

6 Claims, 7 Drawing Figures

NECK SUPPORT

BACKGROUND OF THE INVENTION

1. Field of the Invention

Body contact team sports such as ice hockey, lacrosse and football have progressed to a high degree of sophistication in recent years. With this progress, protecive equipment has been developed for protectng many areas of the body, including the head, kidneys, ribs and shoulders. Football equipment in particular has been developed to the point where some equipment is now used as a weapon, as well as for protection. For example, the new plastic helmets which utilize suspended webbing and foam padding are sometimes used as battering rams in the process of running, blocking and tackling, in a game which is becoming more intense, and the players more aggressive with each passing season. The comfortable and efficient helmets serve to give players a feeling of security, which results in increasing use of the head to force extra yards from a run or apply additional leverage in a block or tackle.

Unfortunately, use of the head as a battering ram in contact sports has resulted in a host of neck injuries which occur when the head is forced forward and downward by impact, and the cervical vertebrae in the neck are hyperflexed or extended and damaged, sometimes causing injury to the discs and/or spinal cord. Blows are delivered to a football player's helmeted head from all directions during a game, and among the most dangerous of these blows is the impact which causes extreme tension in these cervical vertebrae. Sometimes such injuries result from inexperience and/or lack of training, since an ever-increasing number of vertebrae-extension injuries are apparent in young players, and even in players of grade school age. These injuries can be fatal, and frequently result in paralysis, fainting, weakness in the extremities, constant and intermittant pain, and other physical abnormalities. Many less serious cases of strained neck muscles and tendons have been noted, together with the more serious cases of nerve damage, and disc and vertebrae injury. Since the head and neck must be substantially unrestrained to permit a full range of unrestricted motion in order for an athlete to effectively participate in most team contact sports, application of force to the head of a player is transferred directly to his neck, causing injuries of the nature described above.

2. Description of the Prior Art

Probably the most frequently used device for protecting against extreme hyper-flexure or extension of the neck due to an impact on the head in contact sports such as football, is the rubber collar which fits around the neck. Typical of this protection are the neck protector devices disclosed in U.S. Pat. No. 3,497,872 to R. T. Mitchell, and U.S. Pat. No. 3,189,917, to D. F. Sims. The Mitchell device is a U-shaped, resilient member which fits around the neck and is maintained in position by attachment to other items of the athlete's protective gear, such as shoulder pads. The Sims protective device includes a shaped, resilient pad which also fits around the athlete's neck, and prevents movement of the head past a predetermined point during play. A similar device is disclosed in U.S. Pat. No. 3,855,631 to Donald N. Ettinger, which protector is inflatable to define a circular tube which encircles the neck to provide protection against hyper-flexure and extension of the neck in athletic contests such as football. Another "Protective Football Apparatus" is disclosed in U.S. Pat. No. 3,514,784 to R. F. McDavid, which apparatus attaches to the shoulder harness or pads of a football player and prevents extreme movement of the head in any direction, to reduce the likelihood of injuries to the neck and cervical spine. Recent research has indicated that the primary cause of serious neck injuries in football and other team contact sports is hyper-flexure or extension of the cervical vertebrae, which extension results in injury to the vertebrae, discs and/or spinal cord. This injury is usually caused by a blow applied to the head which forces the head violently forward and downward, extending the cervical spine to a point which stresses and causes injury to the vertebrae, and sometimes, irreparable damage to the discs and spinal cord. An effort to prevent injuries of this nature is disclosed in U.S. Pat. No. 3,765,029 to Joseph C. Germain, which includes an "Athletic Protective Device" for attachment to an athlete's shoulder pads at a point beneath his chin. The restraining apparatus spans the top segment of the shoulder pad breast plates, and is said to prevent forward and downward movement of an athlete's head beyond a predetermined, lowered position.

One of the problems inherent in prior art neck protective devices is the failure of such devices to restrain the head from movement sufficiently far downwardly to cause injury to the neck by extension of the cervical vertebrae. The compromise in favor of unrestrained head movement in many of the prior art neck protection devices permits extreme movement of the head downwardly to the point where injury to the cervical spine may not always be prevented, depending upon the age, experience and conditioning of the athlete.

Accordingly, it is an object of this invention to provide a neck support device which is light in weight, easy to use and is compatible with existing protective apparatus used by athletes.

Yet another object of the invention is to provide a protective device for the neck which includes a collar, or a collar segment or segments, each having at least one downwardly-extending frontal support which is secured to the athlete's upper body protective equipment, such as shoulder pads, which collar serves to contact the athlete's chin, and with the frontal support, prevents extreme flexure of the cervical spine resulting from forward and downward head movement due to a blow or blows to the athelete's head.

Another object of the invention is to provide a neck restraining apparatus which includes a collar means and at least one front support extending downwardly from the collar means at a point beneath the athlete's chin, and secured to the protective shoulder pad apparatus worn by the athlete, to intercept the athlete's chin at a predetermined point and prevent hyper-extension of the cervical vertebrae responsive to impact to the athlete's head.

A still further object of the invention is to provide a protective collar or collar segment or segments, which can be attached to the shoulder pads of an athlete, and which is provided with a downwardly-extending front support or supports which are also attached to the shoulder pads, the front support or supports being positioned beneath the athlete's chin and functional to prevent the athlete's head from descending past a predetermined point after the athlete's chin contacts the collar, collar segment or segments.

SUMMARY OF THE INVENTION

These and other objects of the invention are provided in a neck support which is characterized by a collar or collar segment or segments for orientation around an athlete's neck and attached to his protective shoulder pad apparatus, the collar having at least one downwardly-extending front support located beneath the athlete's chin, which front support is also attached to the shoulder pads, the front support and collar cooperating to prevent the athlete's head from extending downwardly past a predetermined point upon contact of the athlete's chin with that portion of the collar located above the front support.

BRIEF DESCRIPTION OF THE DRAWING

The invention will be better understood by reference to the accompanying drawing, wherein.

DESCRIPTION OF THE PREFERRED EMBODIMENTS

Figure 1:
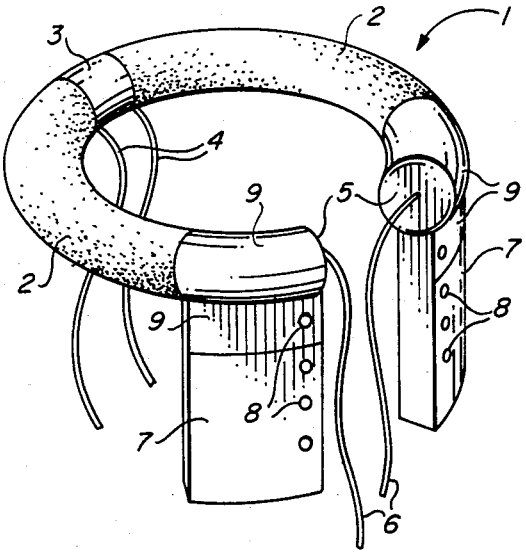
FIG. 1 is a perspective view of a preferred embodiment of the neck support of this invention.

Referring now to FIG. 1 of the drawings, in a preferred embodiment of the invention the neck support is generally illustrated by reference numeral 1, and includes a flexible, shaped collar 2, having matching collar ends 5. A front support 7 is attached to each of the segments of collar 2 lying adjacent collar ends 5, respectively, and extends downwardly from collar 2. Front support apertures 8 are provided along one edge of each front support 7, and in a most preferred embodiment of the invention, each front support 7 is secured to collar 2 by means of a front support wrap 9, as hereinafter described. In another most preferred embodiment, the collar 2 is essentially round in crosssection, and is formed of a relatively soft and resilient sponge rubber, while each front support 7 is shaped from a more stiff sponge rubber material, for reasons which will be more particularly hereinafter set forth.

Figure 4:
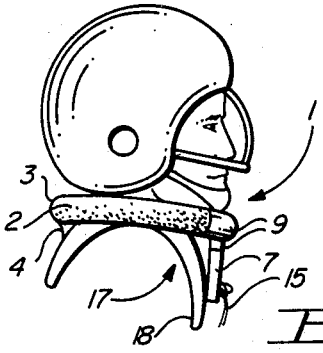
FIG. 4 is a side elevation, partially in section, of the neck support illustrated in FIGS. 1-3, in functional position and worn by an athlete.
Figure 2:
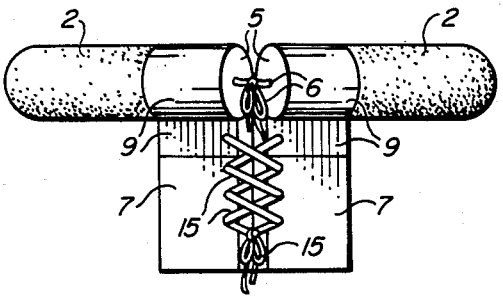
FIG. 2 is a front elevation of the neck support illustrated in FIG. 1, in laced configuration.
Figure 3:
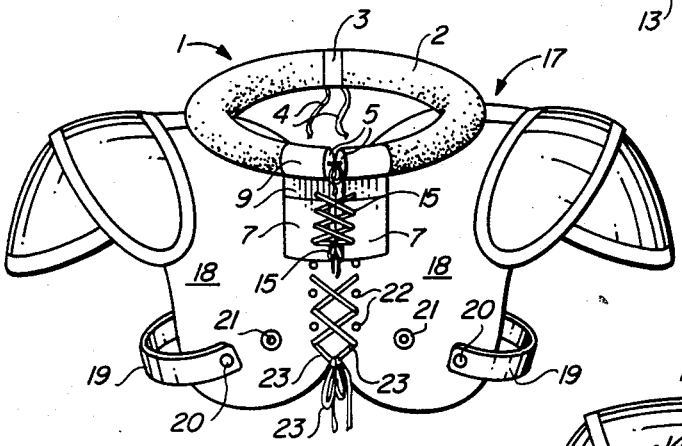
FIG. 3. is a front elevation of the neck support illustrated in FIGS. 1 and 2 in functional position on the shoulder pad or harness of an athlete.

Referring now to FIGS. 1–4, in yet another preferred embodiment of the invention collar laces 6 are embedded in collar ends 5 of collar 2 in order to draw and secure collar ends 5 together, in substantially facing relationship, as illustrated in FIG. 2. A single lace is most preferably provided in collar 2, with an end extending from each of the collar ends 5 to define collar laces 6, respectively, in order to insure that the collar laces 6 will not detach from collar ends 5 when tied together. Front support laces 15 are threaded through front support apertures 8 and through registering breast plate apertures 22 in breast plates 18 of shoulder pads 17, to secure neck support 1 to shoulder pads 17, as illustrated in FIG. 3. The sleeve laces 4, which are attached to collar sleeve 3, mounted on collar 2 at a point opposite collar ends 5, are also secured to shoulder pads 17, as illustrated in FIG. 4, to complete the attachment of neck support 1 to shoulder pads 17.

Figure 7:
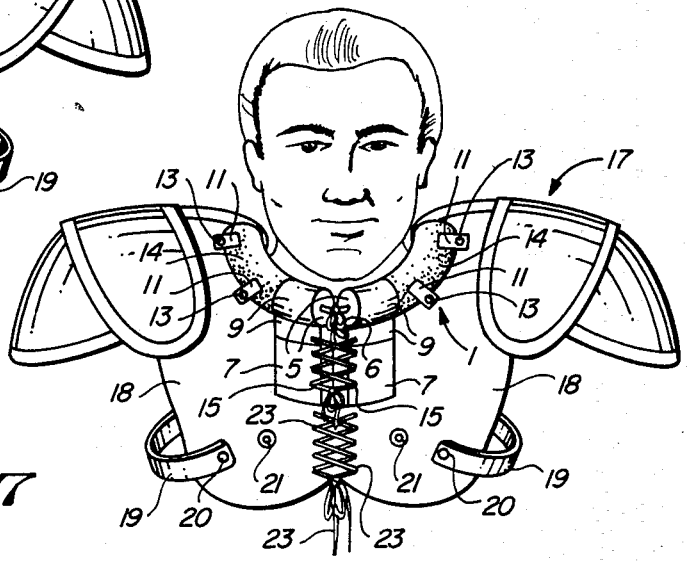
FIG. 7 is a perspective view of the neck support illustrated in FIG. 6, in functional position and worn by an athlete.

Referring now specifically to FIGS. 3, 4, and 7, it will be appreciated that the shoulder pads 17 are standard athletic protective pads which can be used by athletes to participate in team sports such as ice hockey, and particularly, football. The shoulder pads 17 thus include protective breast plates 18, having spaced breast plate apertures 22 along corresponding edges to receive breast plate laces 23, in order to retain the breast plates 18 in position on an athlete's shoulders and chest. The shoulder pads 17 are slipped over the athlete's head as illustrated in FIG. 7, the breast plate laces 23 are then tightened and tied, and body straps 19 are positioned under the athlete's arms and secured to snap receptacles 21 by means of cooperating body strap snaps 20, to secure the shoulder pads 17 in position. Subsequently, the collar 2 of neck support 1 is also slipped over the athlete's head, and collar laces 6 are secured as illustrated in FIGS. 2 and 3, and the front support apertures 8 in each front support 7 are in substantial registration with the breast plate apertures 22, in breast plates 18. This alignment of front support apertures 8 and breast plate apertures 22 facilitates the securing of each front support 7 tightly to one of breast plates 18, respectively, and to each other, by means of front support laces 15, to prevent substantial movement of either front support 7 with respect to breast plates 18. When sleeve laces 4 are secured to shoulder pads 17 as illustrated in FIG. 4, the athlete's chin is positioned immediately above collar ends 5 of collar 2, but the head is free to move in unrestricted fashion in any direction. This mechanical arrangement protects the athlete's neck from hyper-extension or flexure due to blows on the head by preventing forward and downward movement of the head past a predetermined point, due to interception of the jaw with the collar 2 as the head bends forward. Since the collar 2 is formed of a relatively soft, resilient sponge rubber material, or a material of substantially equivalent resiliency and flexibility, the initial shock of impact between the chin and collar 2 is absorbed, but the chin and head are prevented from extreme, injurious flexure by the more rigid, but yieldable construction of each front support 7, as hereinafter described.

Figure 5:
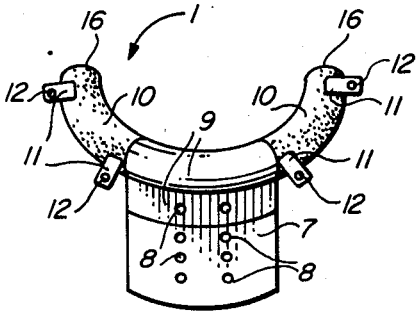
FIG. 5 is a perspective view of another preferred embodiment of the neck support of this invention.

Referring now to FIG. 5 of the drawing, in another preferred embodiment of the invention the neck support 1 is characterized by a collar segment 10, which measures approximately one-half of the length of the collar 2, illustrated in FIGS. 1–4. Collar segment 10 is continuous from rearwardly projecting end segments 16, and extends under the chin of the athlete, and a single front support 7 is attached to the approximate center area of collar segment 10, in the same manner as each front support 7, in the neck support embodiment illustrated in FIGS. 1–4. Front support apertures 8 are provided in spaced relationship in front support 7 to generally coincide with the breast plate apertures 22 in breast plates 18 of shoulder pads 17, as hereinafter described. Tabs 11 are also secured to collar segment 10 in spaced relationship, and are provided with tab apertures 12 for securing the collar segment 10 to the breast plates 18, by means of additional laces (not illustrated). In application, the neck support 1 embodied in FIG. 5 is secured to the breast plates 18 by initially aligning the front support apertures 8 in front support 7 with the underlying breast plate apertures 22 in breast plates 18, and securing the front support 7 to the breast plates 18 by means of front support laces 15. Tabs 11 are then secured to the breast plates 18 by laces threaded through tab apertures 12, as heretofore described.

Figure 6:
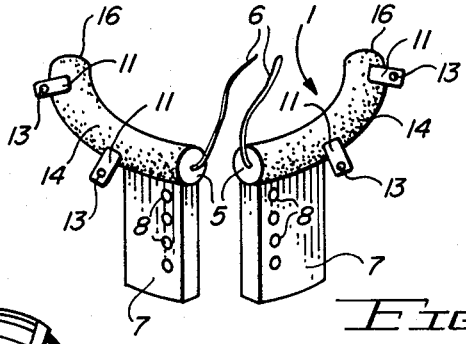
FIG. 6 is a perspective view of yet another preferred embodiment of the neck support.

Yet another embodiment of the neck support 1 is illustrated in FIGS. 6 and 7 of the drawing, where collar quarter-segments 14 are provided with tabs 11 and tab snaps 13 for removable attachment to cooperating snap receptacles (not illustrated) provided near the neck area of breast plates 18, in order to secure neck support 1 to shoulder pads 17, as is particularly illustrated in FIG. 7. As in the case of the collar 2, collar quarter-segments 14 are provided with collar laces 6, extending from collar ends 5, and the opposite ends of collar quarter-segments 14 terminate in end segments 16, as in the case of collar segment 10, illustrated in FIG. 5. Each one of collar quarter-segments 14 is provided with a downwardly-extending front support 7, having spaced front support apertures 8, as in the embodiment illustrated in FIGS. 1–4. Accordingly, collar quarter-segments 14 are secured to shoulder pads 17 by means of tabs 11 and front support laces 15, as illustrated in FIG. 7.

It will be appreciated from a comparison of the embodiment of the invention illustrated in FIG. 5 and those in FIGS. 6 and 7, that tabs 11 may be fitted with substantially any releasable fastener, including laces for registration with the tab apertures 12, and tab snaps 13, which cooperate with snap receptacles, such as the snap receptacles 21, which are secured to breast plates 18 in the appropriate location. Other releasable fasteners such as loop and hook arrangements and loop-pile fasteners known to those skilled in the art can also be used to secure collar segment 10 and collar quater-segments 14 to breast plates 18.

When the neck support 1 in each of the embodiments described above is in proper position on the shoulder pads 17 of an athlete, the combination of collar 2, collar segment 10 or collar quarter-segments 14, and each cooperating front support 7, serve to prevent undesirable extension of the cervical vertebrae due to impact on the head. Referring again to FIGS. 4 and 7, when a blow or blows to the head of an athlete causes the head to move violently forward and downward, the chin initially contacts collar 2, collar segment 10 or collar quarter-segment 14, and causes the respective collar portion to deform, thus absorbing the initial shock of contact. This deformation continues until the chin encounters an increased resistance from the more stiff, but still resilient and yieldable front support 7, which resistance ultimately prevents further downward movement of the chin and head. This interception of the chin and head in turn prevents overextension of the cervical vertebrae, and prevents injury to these vertebrae and other components of the cervical spine. Most importantly, this protection is achieved with no compromise in head movement, as illustrated in FIGS. 4 and 7 of the drawing. The neck support 1 of this invention can be adjusted closer to or farther from the athlete's chin by choosing the proper alignment between front support apertures 8 and cooperating breast plate apertures 22, and applying front support laces 15, accordingly. Furthermore, referring again to FIG. 4, the collar 2 can be adjusted as to the rear extremity collar elevation by tightening or loosening sleeve laces 4, as desired.

While sponge rubber of selected resiliency, flexibility and stiffness is a preferred material of choice for the collar 2, collar segment 10, collar quarter-segments 14 and each cooperating front support 7, it will be recognized that other materials which exhibit the desired yieldable qualities can also be used, according to the knowledge of those skilled in the art. In a most preferred embodiment of the invention, each front support 7 is secured to the collar 2, collar segment 10, and collar quarter-segment 14, respectively, by means of a front support wrap 9, and a soft coating, such as vinyl or latex is applied to prevent chafing or skin irritation, and to prevent absorption of perspiration. An antibacterial agent may also be added to the vinyl or latex, as desired.

While the neck support of this invention can be constructed of any desired size to fit any particular athlete, in a most preferred embodiment the collar 2, collar segment 10 and collar quarter-segments 14 are about two inches in diameter, and in the embodiment illustrated in FIGS. 1–4, collar 2 is from about 23 to about 26 inches in length. In this latter embodiment of the invention, each front support 7 is about 5 $\frac{7}{8}$ inches long, about 2 $\frac{5}{8}$ inches wide and about 1$\frac{1}{4}$ inches thick. These dimensions are also preferred for the front support 7 attached to each of the collar quarter-segments 14, illustrated in FIGS. 6 and 7.

While the preferred embodiments of the invention have been described above, it will be recognized and understood that various other modifications may be made therein and the appended claims are intended to cover all such modifications which may fall within the spirit and scope of the invention.

Having described my invention with the particularity set forth above, what is claimed is:

1. A neck support for use in cooperation with protective athletic equipment to protect an athlete from neck injury comprising:

(a) a generally elongated, yieldable collar shaped substantially into a circle around the athlete's neck, and collar laces extending from the ends of said collar for securing said ends together beneath the athlete's chin; and (b) a pair of generally rectangular-shaped, relatively stiff, but yieldable front supports carried by said collar and extending downwardly from said collar beneath the athlete's chin and a plurality of apertures in spaced relationship in said front supports for securing said front supports to the protective athletic equipment.

2. A neck support for use in cooperation with protective athletic equipment to protect an athlete from neck injury comprising:

(a) a pair of yieldable collar quarter-segments having rear end portions extending rearwardly of the athlete and adjacent the sides of the athlete's neck, and front end portions, respectively, and collar laces extending from said front end portions for securing said front end portions together beneath the athlete's chin, and further comprising a plurality of fastening means carried by said collar quarter-segments for securing said collar quarter-segments to the protective athletic equipment; and (b) front support means carried by said collar quarter-segments and extending downwardly from said collar quarter-segments beneath the athlete's chin, said front support means secured to the protective athletic equipment worn by the athlete.

3. A neck support for use in cooperation with protective athletic equipment to protect an athlete from neck injury comprising:

(a) a yieldable collar segment extending beneath the athlete's chin and having end portions extending rearwardly of the athlete and adjacent the sides of the athlete's neck, and fastening means carried by said collar segment for securing said collar segment to the protective athletic equipment; and (b) front support means carried by said collar segment and extending downwardly from said collar segment beneath the athlete's chin, said front support means secured to the protective athletic equipment worn by the athlete.

4. A neck support apparatus for protecting an athlete from neck injury resulting from over-extension of the cervical spine, comprising:

a. shoulder pad means for protecting the shoulders and chest of the athlete;

b. an elongated, yieldable, generally U-shaped collar having an essentially circular cross-section and oriented around the athlete's neck, with the end segments of said collar facing forwardly of the athlete and provided with collar laces and biased in essentially facing relationship beneath the athlete's chin when said collar laces are tied together; and c. a pair of generally rectangular-shaped, relatively stiff, but yieldable front supports attached to said collar adjacent said ends, respectively, and a plurality of apertures in spaced relationship in said front supports for securing said front supports to the protective athletic equipment.

5. A neck support apparatus for protecting an athlete from neck injury resulting from over-extension of the cervical spine, comprising:

(a) shoulder pad means for protecting the shoulders and chest of the athlete;

(b) a pair of yieldable collar quarter-segments having rear end portions extending rearwardly of the athlete and adjacent the sides of the athlete's neck, and front end portions, respectively, and collar laces extending from said front end portions for securing said front end portions together beneath the athlete's chin, and further comprising a plurality of fastening means carried by said collar quarter-segments for securing said collar quarter-segments to said shoulder pads; and (c) a pair of generally rectangular-shaped, relatively stiff, but yieldable front supports carried by said front end portions of said collar quarter-segments, respectively, and extending downwardly from said collar quarter-segments for attachment to said shoulder pad means.

6. The neck support of claim 5 wherein said shoulder pad means is football shoulder pads having shoulder pad apertures, and said front supports are each provided with front support apertures, and further comprising cooperating front support laces for sequential insertion in said front support apertures and in said shoulder pad apertures for securing said front supports to said shoulder pads.

* * * * *